US007003804B2

(12) United States Patent
Lewis

(10) Patent No.: US 7,003,804 B2
(45) Date of Patent: Feb. 28, 2006

(54) SURGICAL GOWN INCORPORATING A SKIN WELLNESS AGENT

(75) Inventor: Andrea L. Lewis, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 38 days.

(21) Appl. No.: 10/732,820

(22) Filed: Dec. 10, 2003

(65) Prior Publication Data

US 2005/0125873 A1 Jun. 16, 2005

(51) Int. Cl.
*A41D 13/00* (2006.01)

(52) U.S. Cl. ..... 2/51; 2/114

(58) Field of Classification Search ..... 2/51, 2/46, 69, 114–115, 125, 126, 243.1, 79, 78.1–78.4, 2/73, 80, 83, 267, 1, 268, 108, 85, 93; 602/3, 602/41–59, 75; 128/888–892; 424/400–402, 424/420, 443–448, 78.02–78.03; 604/358, 604/363, 364, 368–375, 385.01–390
See application file for complete search history.

(56) References Cited

U.S. PATENT DOCUMENTS 2,239,998 A * 4/1941 Fellegi ..... 2/125
3,156,927 A * 11/1964 Grimm et al. ..... 2/83
3,570,012 A 3/1971 Winters
3,798,678 A * 3/1974 Pierron et al. ..... 2/243.1
3,896,807 A 7/1975 Buchalter
4,631,756 A * 12/1986 Scrivens ..... 2/114
5,097,534 A 3/1992 Viemeister et al.
5,724,674 A 3/1998 Covington et al.
5,794,276 A 8/1998 Walker
5,933,564 A * 8/1999 Pavlath ..... 385/139
6,052,826 A 4/2000 Tolton
6,115,839 A 9/2000 Covington et al.
6,530,090 B1 3/2003 Ambrose et al.
6,548,728 B1 * 4/2003 Faries et al. ..... 602/42
6,656,168 B1 12/2003 Braverman et al.
6,695,678 B1 * 2/2004 Foley et al. ..... 450/57
2003/0017193 A1 1/2003 Chou
2003/0221237 A1 12/2003 Griesbach et al.

FOREIGN PATENT DOCUMENTS

WO WO 9717919 5/1997

* cited by examiner

*Primary Examiner*—Gloria M. Hale
(74) *Attorney, Agent, or Firm*—Dority & Manning

(57) ABSTRACT

A protective garment, such as a surgical gown, includes a front portion, a back portion, and sleeves. A skin wellness agent is deposited on an inner body-facing surface of at least one of the front portion, back portion, and sleeves, and may also be provided in the sleeve cuffs. The skin wellness agent is transferred to the wearer's skin through contact with the inner body-facing surface of the garment.

8 Claims, 5 Drawing Sheets

SURGICAL GOWN INCORPORATING A SKIN WELLNESS AGENT

TECHNICAL FIELD OF THE INVENTION

The present invention relates generally to the field of protective garments, and more particularly to an improved surgical gown configuration.

BACKGROUND

Protective garments such as surgical gowns are well known. Conventional disposable surgical gowns are commonly constructed from a nonwoven fabric. The gown body section is generally a singular piece of material, or is composed of a number of panels of material attached together. For example, the gown may be formed from a front panel and attached side panels that also define a back section of the gown. Sleeves are attached to the gown body by any number of known techniques. An example of a surgical gown made using raglan-type sleeves attached to a one piece gown body is the Lightweight Gown (product code 90751) from Kimberly-Clark, Corp. of Neenah, Wis., USA.

The usefulness of these gowns is generally influenced by a number of factors, such as breathability, resistance to fluid flow, barrier protection qualities, etc. Unfortunately, in certain applications, the desired characteristics of the gown from a protection standpoint may result in skin irritation and discomfort for many individuals. This may be particularly true in the medical field wherein the clinician undergoes a rigorous scrubbing in preparation for a medical procedure prior to donning the gown. The disinfectants, soaps, and other scrubbing agents are necessary, but are harsh on many individuals' skin. Such scrubbings leave many individuals with dry and chapped skin, particularly on the arms where the scrubbing is most intense. Once the gowns are donned, it is not possible to alleviate the skin discomfort and irritation. Also, it is generally not acceptable to apply skin conditioning lotions or agents to the arms after scrubbing so as not to compromise the sterile field.

The present invention addresses certain drawbacks noted above and provides an improved gown that treats a wearer's arms with a skin wellness agent after donning the gown.

SUMMARY

Objects and advantages of the invention will be set forth in part in the following description, or may be obvious from the description, or may be learned through practice of the invention.

The present invention relates to a unique configuration for a protective garment, particularly a surgical gown, having a front portion, a back portion, and sleeves. A skin wellness agent is deposited on an inner body-facing surface of a portion of the gown. The skin wellness agent is transferred to the wearer's skin through contact with the inner body-facing surface and provides the wearer with particular benefits depending on the type of agent. The skin wellness agent may be provided on the inner surface of any one or combination of the gown portions. For example, the agent may be provided on the inner surface of the back or front portions of the gown that generally conform to the wearer's body.

In a particular embodiment, the skin wellness agent is applied to a portion of the protective garment that is in generally continuous contact with the wearer's skin. This portion may be a form-fitting portion in that is generally snug against the wearer's skin. For example, the form-fitting portion may be a portion of the sleeves, such as the forearm portion defined below a loose fitting upper arm portion, and may also include a cuff.

The skin wellness agent may be applied by any one or combination of conventional application techniques. The agent may be deposited in a generally uniform coating on the inner body-facing surface of the gown portion or, alternatively, may be applied to a desired region in discrete localized deposits, such as stripes or bands, and so forth.

In a particular embodiment, the skin wellness agent may be a lotion formulation that can vary broadly within the scope and spirit of the invention. Various formulations are widely known and used in the art for providing skin wellness benefits and to address or prevent particular skin disorders or irritating conditions, including pain, itching, chapping, inflammation, and other skin disorders. It may be desired that the lotion formulation include at least one emollient that acts as a lubricant to reduce abrasiveness of gown material against the skin and, upon transfer to the skin, helps to maintain skin condition. The emollient may be selected, for example, from the group consisting of oils, esters, glycerol esters, ethers, alkoxylated carboxylic acids, alkoxylated alcohols, fatty alcohols, and mixtures thereof.

The lotion formulation may also include at least one wax selected, for example, from the group consisting of animal based waxes, vegetable based waxes, mineral based waxes, silicone based waxes, and mixtures thereof and all of which may be natural or synthetic. The wax selected may be natural, synthetic, or a combination thereof.

The lotion formulation may also include at least one skin protectant to protect injured or exposed skin from harmful or irritating stimuli.

The invention has particular usefulness with respect to surgical gowns used in the medical industry. In a particular gown embodiment, the gown body has front and back portions that define sleeve openings. Sleeves formed from folded blank material members are attached to the sleeve openings along a generally continuous sleeve seam. The sleeves have an upper arm section, a lower forearm section, and cuffs at the end thereof. The sleeves may further include a form-fitting section defined between the upper arm section and the cuff corresponding to the forearm section of the sleeve. This section may be form-fitting in that it has a reduced circumference so as to fit snuggly against the wearer's forearm, as compared to the upper arm section that may be relatively loose fitting. The form-fitting section may also be formed from an elastomeric material, or may be inherently extensible. The form-fitting sleeve section may include the elastomeric cuff.

The invention will be described below with reference to surgical gown embodiments illustrated in the figures.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION

Figure 1:
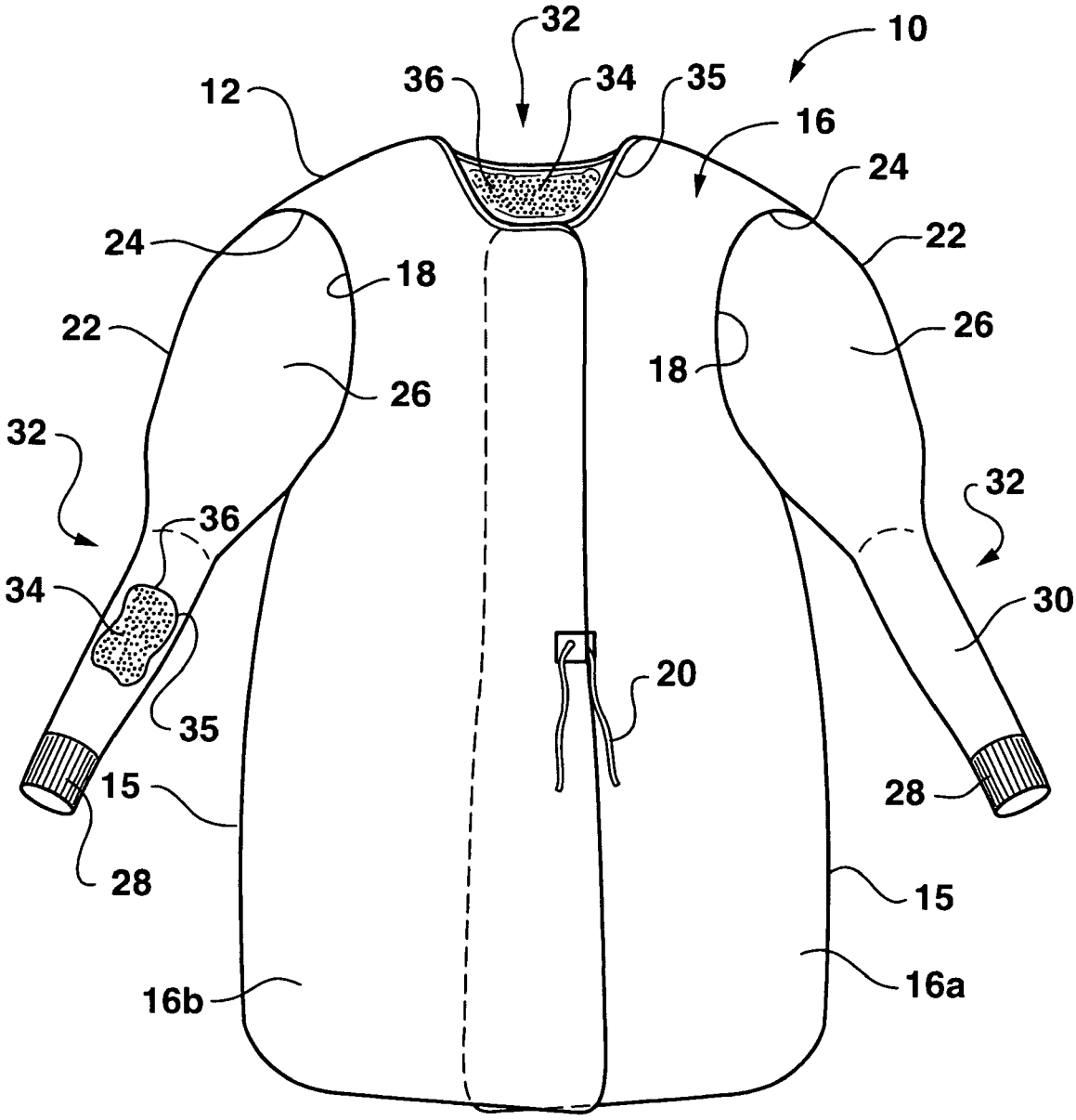
FIG. 1 is a perspective and partial back view of a protective garment, in particular a surgical gown, in accordance with the invention.

Reference will now be made in detail to one or more embodiments of the invention, examples of which are graphically illustrated in the drawings. Each example and embodiment are provided by way of explanation of the invention, and not meant as a limitation of the invention. For example, features illustrated or described as part of one embodiment may be utilized with another embodiment to yield still a further embodiment. It is intended that the present invention include these and other modifications and variations.

"Attached" refers to the bonding, joining, adhering, connecting, attaching, or the like, of two elements. Two elements may be considered attached together when they are bonded directly to one another or indirectly to one another, such as when each is directly attached to an intermediate element.

"Elastomeric" refers to a material or composite which can be extended or elongated by at least 25% of its relaxed length and which will recover, upon release of the applied force, at least 10% of its elongation. It is generally preferred that the elastomeric material or composite be capable of being elongated by at least 100%, recover at least 50% of its elongation. An elastomeric material is thus stretchable and "stretchable" and "elastomeric" may be used interchangeably.

"Elastic" or "Elasticized" means that property of a material or composite by virtue of which it tends to recover towards its original size and shape after removal of a force causing a deformation.

"Neck-bonded" laminate refers to a composite material having an elastic member that is bonded to a non-elastic member while the non-elastomeric member is extended in the machine direction creating a necked material that is elastic in the transverse or cross-direction. Examples of neck-bonded laminates are disclosed in U.S. Pat. Nos. 4,965,122; 4,981,747; 5,226,992; and 5,336,545, which are incorporated herein by reference in their entirety for all purposes.

"Stretch-bonded" laminate refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25% of its relaxed length. Such a multiplayer composite elastic material may be stretched until the non-elastic layer is fully extended. Examples of stretch-bonded laminates are disclosed, for example, in U.S. Pat. Nos. 4,720,415, 4,789,699, 4,781,966, 4,657,802, and 4,655,760, which are incorporated herein by reference in their entirety for all purposes.

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing and melt spinning processes, spunbonding processes and bonded carded web processes.

As used herein, the term "spunbonded web" refers to web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown web" refers to a nonwoven web formed by extruding a molten thermoplastic material through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that may be continuous or discontinuous, are generally smaller than 10 microns in diameter, and are generally tacky when deposited onto a collecting surface.

As used herein, the term "disposable" is not limited to single use or limited use articles but also refers to articles that are so inexpensive to the consumer that they can be discarded if they become soiled or otherwise unusable after only one or a few uses.

As used herein, the term "garment" refers to protective garments and/or shields including for example, but not limited to, surgical gowns, patient drapes, work suits, aprons and the like.

As used herein, the term "liquid resistant" or "liquid repellant" refers to material having a hydrostatic head of at least about 25 centimeters as determined in accordance with the standard hydrostatic pressure test AATCCTM No. 127-1977 with the following exceptions: (1) The samples are larger than usual and are mounted in a stretching frame that clamps onto the cross-machine direction ends of the sample, such that the samples may be tested under a variety of stretch conditions (e.g., 10%, 20%, 30%, 40% stretch); and (2) The samples are supported underneath by a wire mesh to prevent the sample from sagging under the weight of the column of water.

As used herein, the term "breathable" means pervious to water vapor and gases. For instance, "breathable barriers" and "breathable films" allow water vapor to pass therethrough, but are liquid resistant. The "breathability" of a material is measured in terms of water vapor transmission rate (WVTR), with higher values representing a more breathable material and lower values representing a less breathable material. Breathable materials generally have a WVTR of greater than about 250 grams per square meter per 24 hours ($g/m^2/24$ hours). In some embodiments, the WVTR may be greater than about 1000 $g/m^2/24$ hours. Further, in some embodiments, the WVTR may be greater than about 3000 $g/m^2/24$ hours. In some embodiments, the WVTR may be greater than about 5000 $g/m^2/24$ hours.

As used herein, the term "reversibly-necked material" refers to a necked material that has been treated while necked to impart memory to the material so that when force is applied to extend the material to its pre-necked dimensions, the necked and treated portions will generally recover to their necked dimensions upon termination of the force. A reversibly-necked material may include more than one layer. For example, multiple layers of spunbonded web, multiple layers of meltblown web, multiple layers of bonded carded web or any other suitable combination of mixtures thereof. The production of reversibly-necked materials is illustrated in patents such as, for example, Mormon, U.S. Pat. Nos. 4,965,122 and 4,981,747.

The present invention relates to a unique configuration for a protective garment. The garment is illustrated and described herein as a surgical gown for illustrative purposes. It should be appreciated though that a garment in accordance with the invention is not limited to a gown, and may include, for example, a patient gown or drape, work coverall, robe, etc.

Figure 2:
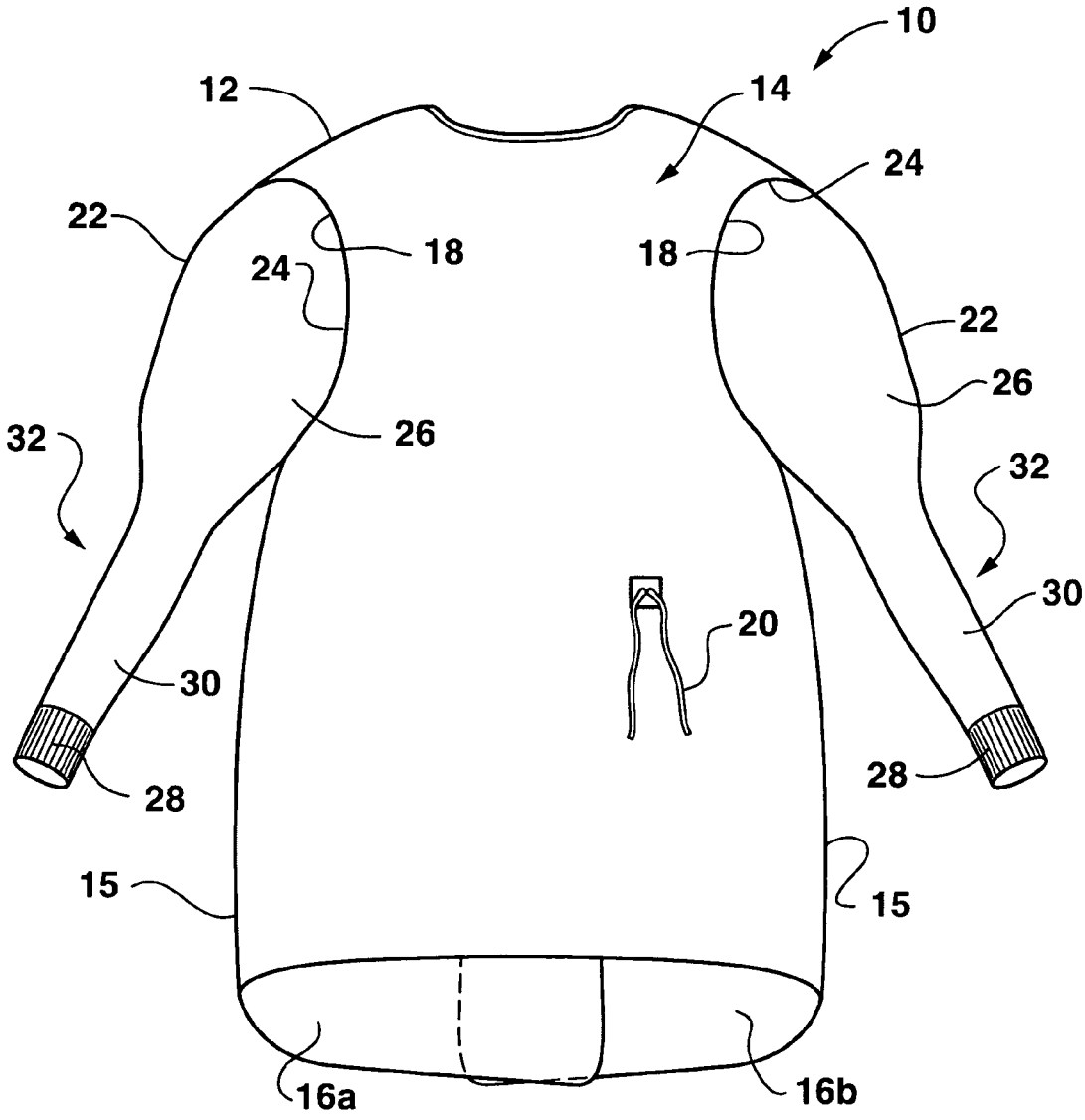
FIG. 2 is a front perspective view of the gown shown in FIG. 1.

A conventional gown 10 is conceptually illustrated in FIGS. 1 and 2. The gown includes a gown body 12 having a front portion 14 and a back portion 16. The gown body may be formed from a single piece of material, or may be defined by separate panels of material joined at seams. For example, the front portion may be a first panel, and the back portion may be formed from separate panels 16*a* and 16*b* attached to the front panel portion 14 along longitudinal sides seams 15.

Sleeves 22 are generally attached to the gown body 12 at sleeve openings 18 defined in the body 12. The sleeves 22 may include any manner of known elastomeric cuff 28 at the ends thereof. The sleeves 22 may be formed from blank material members of the same or a different material as the body 12 and separately attached to openings 18 along a generally continuous sleeve seam 24. Any type of known fastening means, such as conventional ties 20, may be used for securing the gown 10 on a wearer. Various configurations of gowns 10 are well known to those skilled in the art and all such configurations are within the scope and spirit of the invention.

The gown body 12 is desirably formed of a material that is breathable yet liquid resistant barrier material. The breathability of the material increases the comfort of someone wearing such a garment, especially if the garment is worn under high heat index conditions, vigorous physical activity, or long periods of time. Various suitable woven and non-woven barrier materials are known and used in the art for garments such as surgical gowns, and all such materials are within the scope of the present invention. A suitable gown material is, for example, a Spunbond-Meltblown-Spunbond laminate as described in U.S. Pat. No. 5,464,688, incorporated herein by reference for all purposes, with appropriate chemical treatments to enhance liquid repellency and static decay.

The gown 10 includes a skin wellness agent 34 deposited in an area 36 on an inner body-facing surface 35 of a portion of the gown. The skin wellness agent 34 is transferred to the wearer's skin through contact with the inner body-facing surface 35 and provides the wearer with particular benefits depending on the type of agent. Suitable skin wellness agents 34 will be described in detail below. The skin wellness agent 34 may be provided on the inner body-facing surface 35 of any one or combination of the gown portions. For example, in the embodiment of FIGS. 1 and 2, the agent 34 is deposited in defined areas 36 on the inner body-facing surface 35 of the front gown portion 14. An area 36 may also be defined on one or both sides of the back portion 16. It should be appreciated that areas 36 of a skin wellness agent 34 may be provided on the body-facing surface 35 of any portion of the gown wherein the agent 34 is readily transferred to the wearer through generally continuous contact with the wearer's skin. This portion may be a form-fitting portion 32 in that is generally snug against the wearer's skin.

In a particular embodiment, the form-fitting portion 32 is a portion of the sleeves 22, such as the lower or forearm portion 30 defined between a loose fitting upper arm portion 26 and the cuff 28, or may include the cuff 28. As depicted in FIG. 1, an area 36 of skin wellness agent 34 is provided on the inner body-facing surface 35 of the sleeves 22 generally between the elbow and wrist portions of the sleeves 22. The skin wellness agent 34 may also be provided on the inner-body facing surface of the cuffs 28.

Figure 3A:
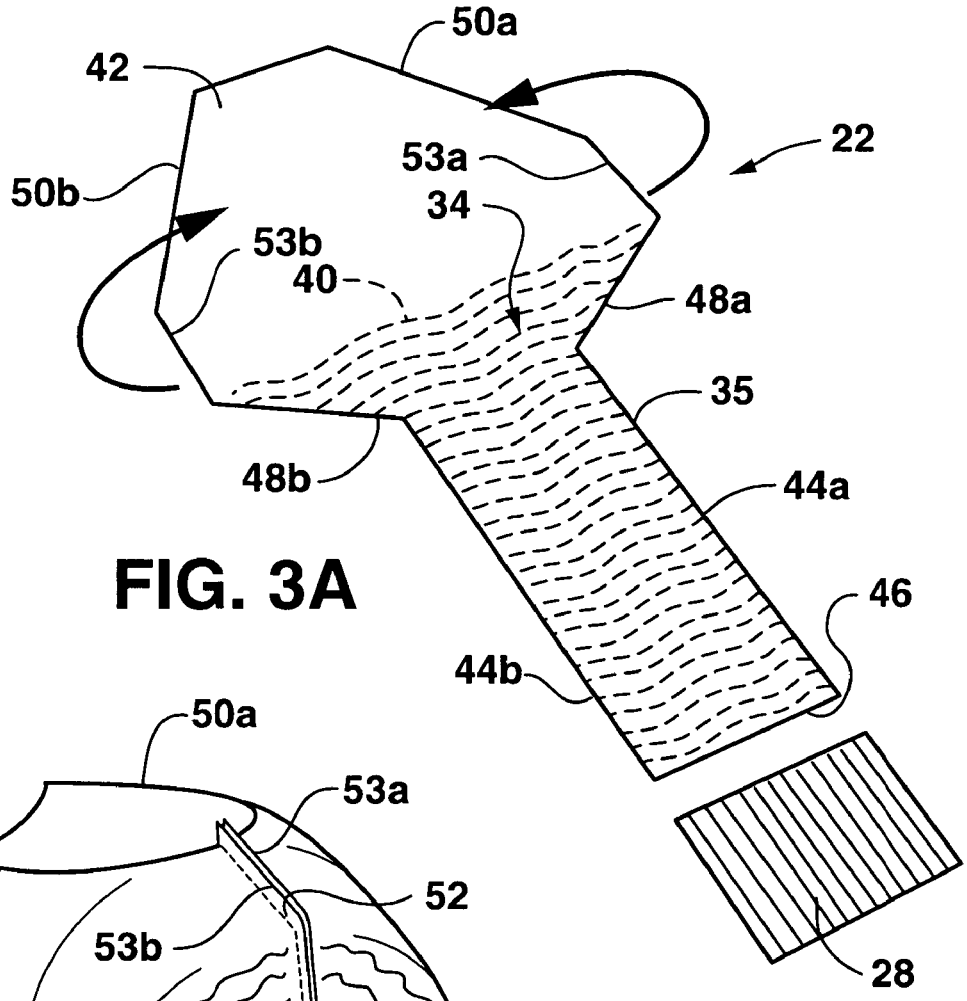
FIGS. 3A, 3B, and 3C illustrate a blank material member being formed into a sleeve for subsequent attachment to a garment in accordance with the invention.
Figure 3B:
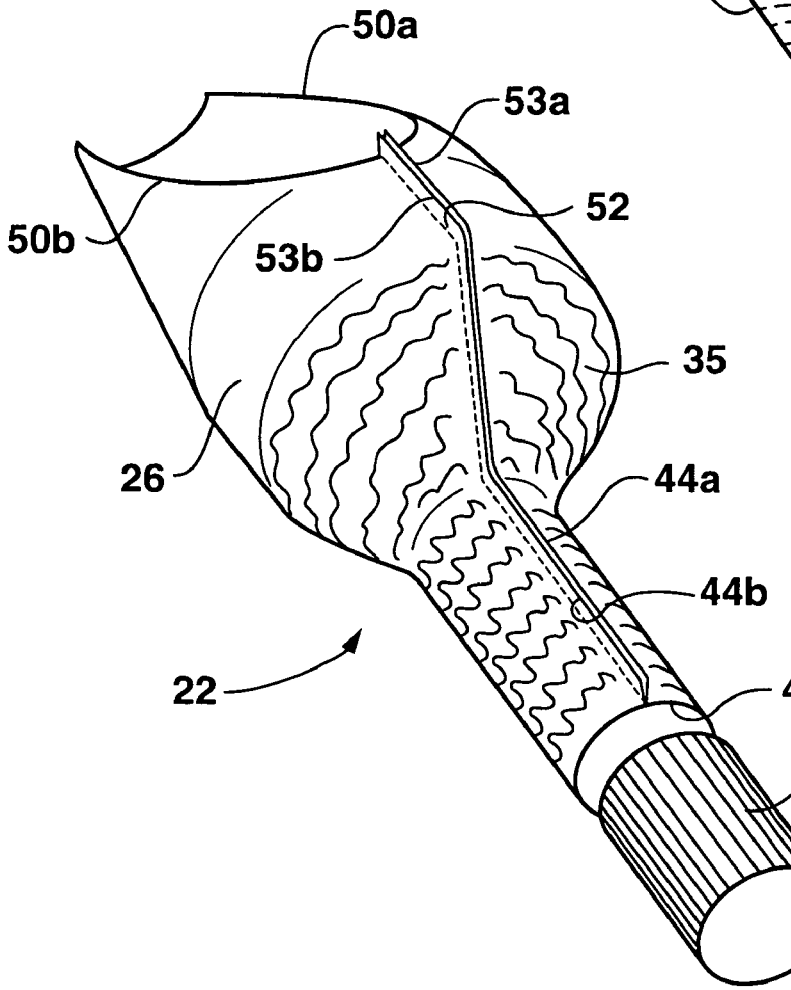
Figure 3C:
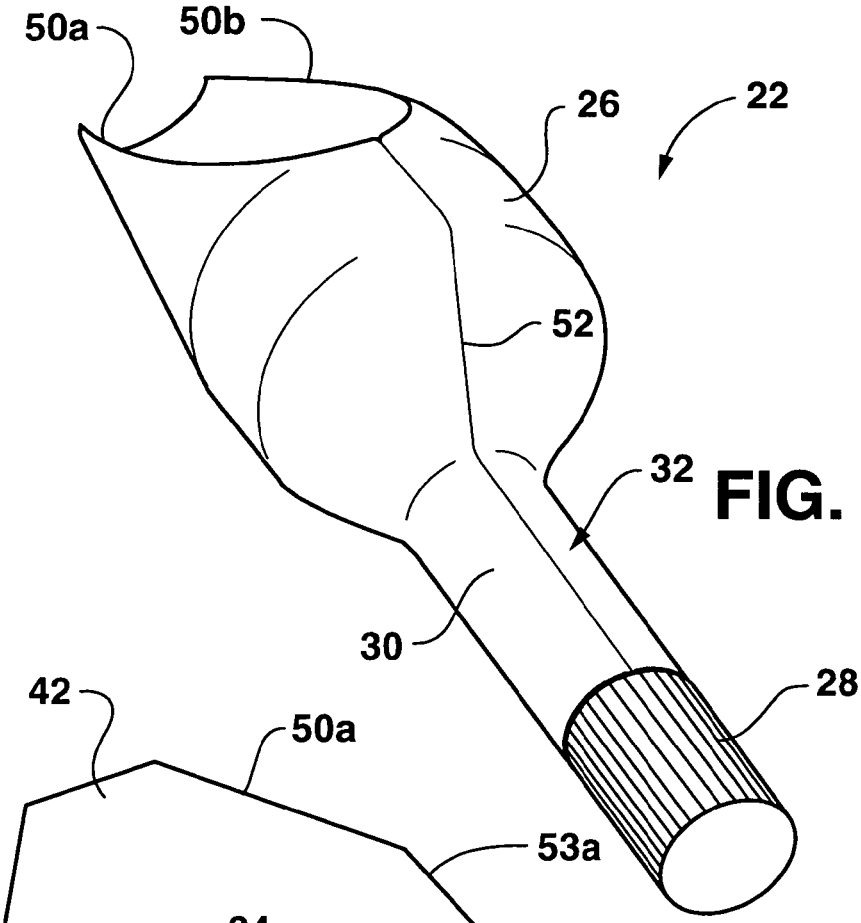

FIGS. 3A through 3C illustrate a sleeve embodiment that is particularly useful with gowns 10 according to the invention. Each sleeve 22 is separately formed from a blank material member 42. The material member 42 may be an elastomeric material, as discussed in detail below. The material members 42 are cut so as to define a complete sleeve 22 once folded. The sleeves 22 are then attached to the sleeve openings 18 in the gown body 12. The blank material members 42 include sleeve opening edges 50*a* and 50*b*, and lateral side edges 53*a* and 53*b* that define the upper arm section 26 of the folded sleeve 22. Lateral edges 44*a* and 44*b* form the reduced circumference lower arm section 30 of the folded sleeve 22. Angled side edges 48*a* and 48*b* form a transition zone between the upper arm section 26 and lower arm section 30.

FIGS. 3A and 3B show the skin wellness agent 34 applied to the inner body-facing surface 35 of the lower arm section 30. The agent may also be applied to a part of the transition zone between the upper arm section 26 and lower arm section 30.

FIG. 3B illustrates the blank material member 42 after it has been folded and the edges 44*a*/44*b*, 48*a*/48*b*, and 53*a*/53*b* sealed along a generally continuous single seam 52 by any suitable sealing technique. The elastomeric cuff 28 is then attached to the longitudinal end 46, and may also include the skin wellness agent applied to the body-facing surface thereof. With this embodiment, the sleeves are folded along a single line and sealed along a single continuous seam 52.

FIG. 3C illustrates the folded and seamed sleeve 22 after it has been inverted such that the skin wellness agent is disposed on the inside of the sleeve 22. The sleeves 22 are then attached to the sleeve openings 18 in the gown body, as is understood in the art.

Figure 4A:
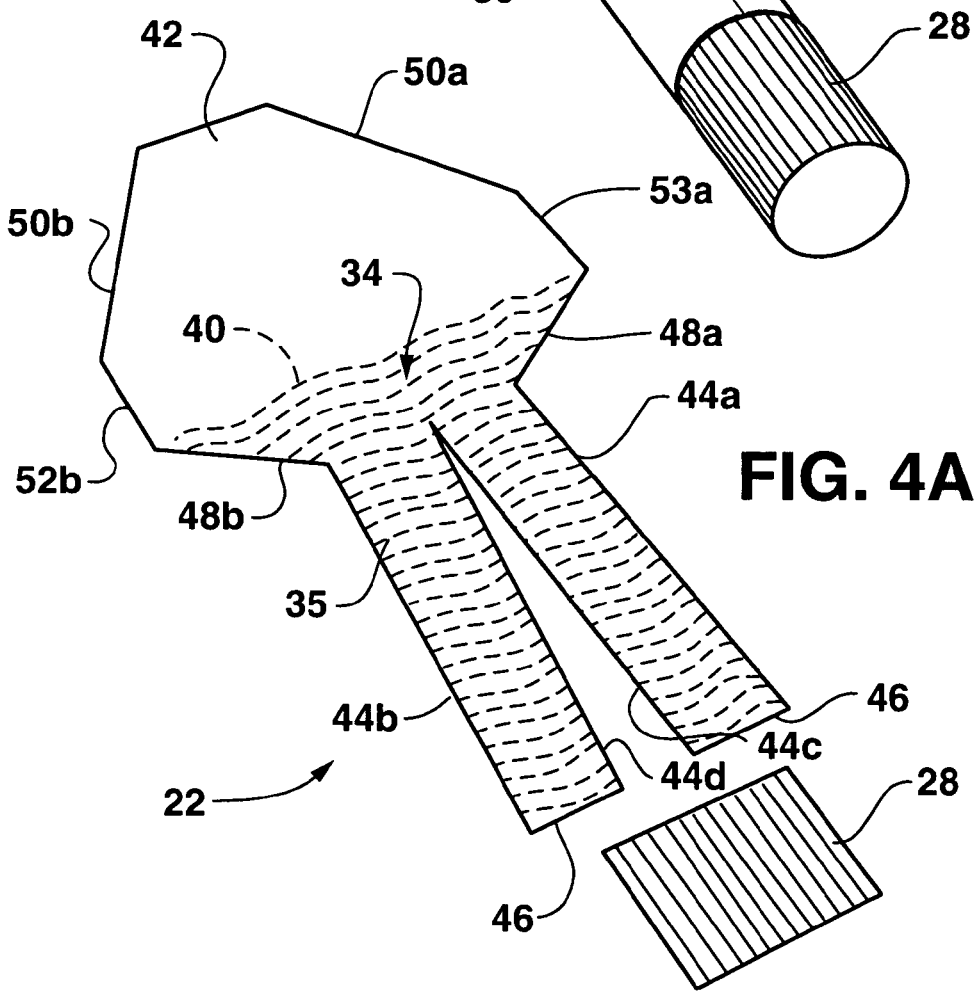
FIGS. 4A, 4B, and 4C illustrate a blank material member being formed into an alternate sleeve embodiment for subsequent attachment to a garment in accordance with the invention.
Figure 4B:
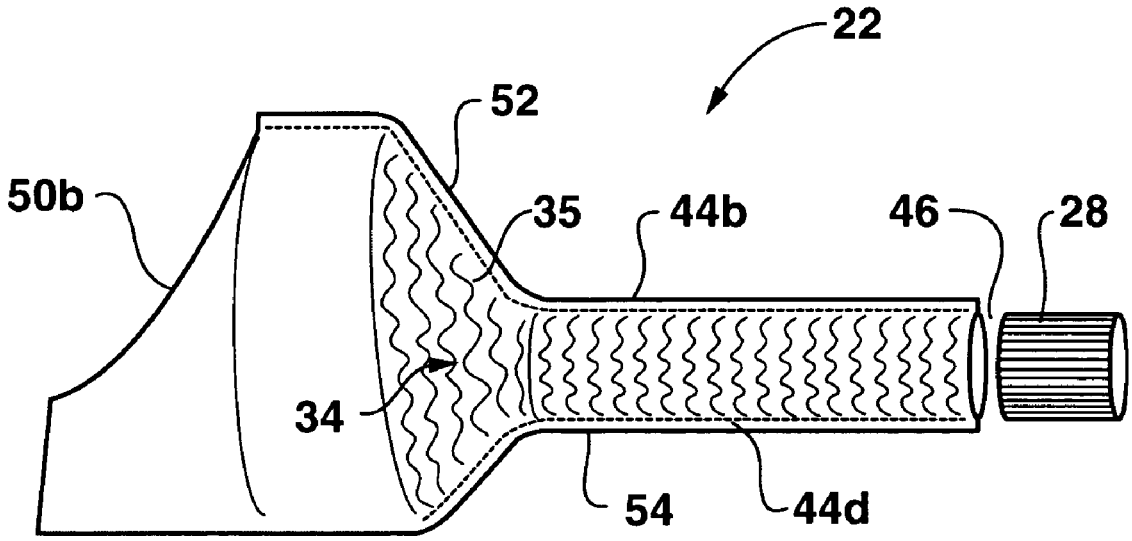
Figure 4C:
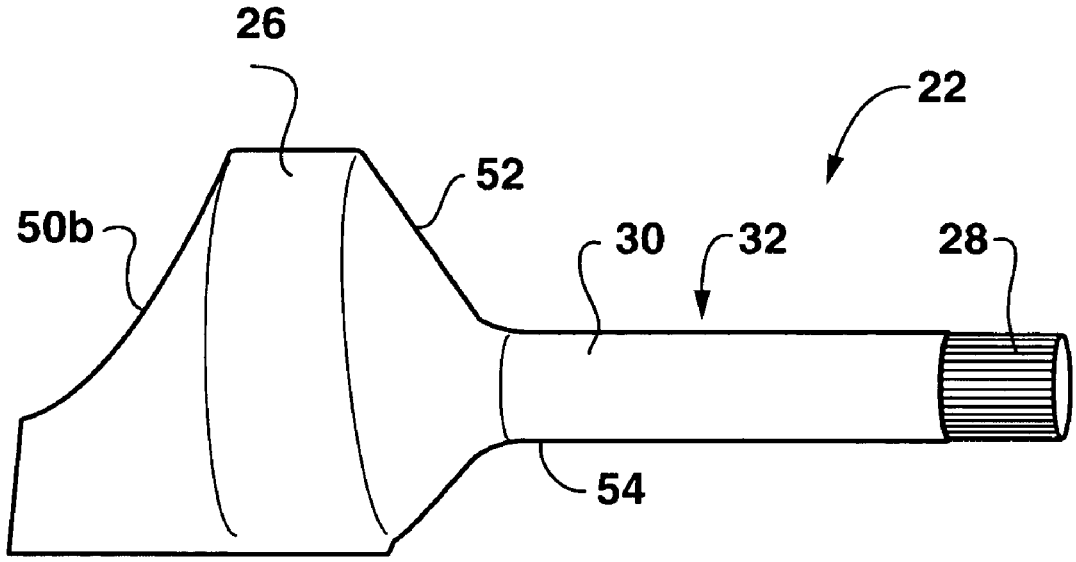

FIGS. 4A through 4C illustrate an alternative sleeve embodiment. Referring to FIG. 4A, the lower arm section 30 of the blank material member 42 is defined by outer lateral edges 44*a* and 44*b*, and opposite inner lateral edges 44*c* and 44*d* such that the lower arm section 30 is defined by two separate extensions that are joined as indicated in FIG. 4B along first seam 52 and second seam 54. FIG. 4B illustrates the skin wellness agent 34 applied to inner body-facing surface 35, and FIG. 4C illustrates the sleeve 22 after being inverted and prior to attachment to the sleeve openings 18 in the gown body 12.

The skin wellness agent 34 may be applied by any one or combination of conventional application techniques. For example, the skin wellness agent 34 may be sprayed or slot coated onto the gown material. Other methods include rotogravure or flexographic printing techniques. The agent may be deposited in a generally uniform coating on the inner body-facing surface 35 of the gown portion, as graphically indicated by the spray pattern of the areas 36 in FIG. 1. Alternatively, the agent 34 may be applied to a desired region in discrete localized deposits, such as stripes or bands 40 as indicated in FIGS. 3A and 4A.

The portion of the gown 12 containing the skin wellness agent may be rendered form-fitting in various ways. For example, referring to the embodiments wherein the agent 34 is deposited on the body-facing surface 35 of the sleeves 22, the form-fitting portion 32 may simply be a reduced circumference length of the sleeve 22 as described above with respect to FIGS. 3A–3C and 4A–4C so as to fit snuggly against the wearer's forearm, as compared to the upper arm section 26 that may be relatively loose fitting. The sleeve material may have a degree of inherent extensibility so that the sleeves 22 may be easily donned without rupturing the sleeve seams.

In an alternate embodiment, the form-fitting section 32 may be formed from an elastomeric material, and include for example the cuffs 28. For example, the sleeve material may be entirely elastomeric, or only the form-fitting section 32 may be elastomeric. Elastomeric material may be desirable in that it will readily conform to the wearer's body and can be easily donned. Various elastomeric materials are known in the art that may be used for the form-fitting sections 32. The sections 32 may, for example, be composed of a single layer, multiple layers, laminates, spunbond fabrics, films, meltblown fabrics, elastic netting, microporous web, bonded carded webs or foams comprised of elastomeric or polymeric materials. Elastomeric nonwoven laminate webs may include a nonwoven material joined to one or more gatherable nonwoven webs, films, or foams. Stretch-bonded laminates (SBL) and Neck-bonded laminates (NBL) are examples of elastomeric nonwoven laminate webs. Nonwoven fabrics are any web of material which has been formed without the use of textile weaving processes which produce a structure of individual fibers which are interwoven in an identifiable repeating manner. Examples of suitable materials are Spunbond-Meltblown fabrics, Spunbond-Meltblown-Spunbond fabrics, Spunbond fabrics, or laminates of such fabrics with films, foams, or other nonwoven webs. Elastomeric materials may include cast or blown films, foams, or meltblown fabrics composed of polyethylene, polypropylene, or polyolefin copolymers, as well as combinations thereof. The elastomeric materials may include polyether block amides such as PEBAX® elastomer (available from AtoChem located in Philadelphia, Pa.), thermoplastic polyurethanes (e.g., both aliphatic-polyether and aliphatic-polyester types), HYTREL® elastomeric copolyester (available from E. I. DuPont de Nemours located in Wilmington, Del.), KRATON® elastomer (available from Shell Chemical Company located in Houston, Tex.), or strands of LYCRA® elastomer (available from E. I. DuPont de Nemous located in Wilmington, Del.), or the like, as well as combinations thereof. The form-fitting sections 32 may include materials that have elastomeric properties through a mechanical process, printing process, heating process, or chemical treatment. For examples such materials may be apertured, creped, neck-stretched, heat activated, embossed, and micro-strained; and may be in the form of films, webs, and laminates.

In a particular embodiment, the skin wellness agent 34 may be a lotion formulation that can vary broadly within the scope and spirit of the invention. Various formulations are widely known and used in the art for providing skin wellness benefits and to address or prevent particular skin disorders or irritating conditions, including pain, itching, chapping, inflammation, and other skin disorders. The amount of lotion may vary widely within the scope of the invention. For example, it may be desired that the lotion formulation be present at an add-on weight of between about 0.5% to about 50% of the weight of the gown material. Although not a requirement of the invention, the lotion formulation may be substantially solid at room temperature and thus have a decreased tendency to penetrate and migrate into the gown material during processing and elevated storage temperatures. It is desired that the lotion formulation remain substantially on the inner body-facing surface 35 where it can contact and transfer to the wearer's skin to provide the desired skin health benefit.

The lotion deposit(s) may be in addition to an overall skin wellness treatment applied uniformly to the gown material. For example, the gown material may be treated with a surfactant that includes a skin wellness additive, or a skin wellness additive may be applied in an additional process. Any of the skin wellness additives discussed herein with respect to the lotion formulation may be applied as a separate overall treatment to the material.

The invention is not limited to any particular lotion formulation. The lotion formulation may include any combination of emollients, and may also include one or more waxes. A viscosity enhancer may also be included. The lotion formulation may include other ingredients as well.

An emollient may be desired to act as a lubricant to reduce the abrasiveness of the gown material against the wearer's skin and, upon transfer to the skin, help to maintain the soft, smooth and pliable appearance of the skin. Suitable emollients which can be incorporated into the lotion formulation include oils such as petroleum based oils, vegetable based oils, mineral oils, natural or synthetic oils, silicone oils, lanolin and lanolin derivatives, kaolin and kaolin derivatives and the like and mixtures thereof; esters such as cetyl palmitate, stearyl palmitate, cetyl stearate, isopropyl laurate, isopropyl myristate, isopropyl palmitate and the like and mixtures thereof; glycerol esters; ethers such as eucalyptol, cetearyl glucoside, dimethyl isosorbicide polyglyceryl-3 cetyl ether, polyglyceryl-3 decyltetradecanol, propylene glycol myristyl ether and the like and mixtures thereof; alkoxylated carboxylic acids; alkoxylated alcohols; fatty alcohols such as octyldodecanol, lauryl, myristyl, cetyl, stearyl and behenyl alcohol and the like and mixtures thereof; and the like and mixtures thereof. For example, a particularly well suited emollient is petrolatum. Other conventional emollients may also be added in a manner which maintains the desired properties of the lotion formulations set forth herein.

To provide the improved stability and transfer to the skin of the wearer, the lotion formulation may include from about 5 to about 95 weight percent, desirably from about 20 to about 75 weight percent, and more desirably from about 40 to about 60 weight percent of the emollient.

The lotion formulation may include a wax that primarily functions as an immobilizing agent for the emollient and any active ingredient. In addition to immobilizing the emollient and reducing it's tendency to migrate, the wax in the lotion formulation provides a tackiness to the lotion formulation which improves the transfer to the skin of the wearer. The presence of the wax also modifies the mode of transfer in that the lotion tends to fracture or flake off instead of actually rubbing off onto the skin of the wearer which can lead to improved transfer to the skin. The wax may further function as an emollient, occlusive agent, moisturizer, barrier enhancer and combinations thereof.

Suitable waxes which can be incorporated into the lotion formulation include animal, vegetable, mineral or silicone based waxes which may be natural or synthetic such as, for example, bayberry wax, beeswax, C30 alkyl dimethicone, candelilla wax, carnauba, ceresin, cetyl esters, esparto, hydrogenated cottonseed oil, hydrogenated jojoba oil, hydrogenated jojoba wax, hydrogenated microcrystalline wax, hydrogenated rice bran wax, japan wax, jojoba butter, jojoba esters, jojoba wax, lanolin wax, microcryustalline wax, mink wax, motan acid wax, motan wax, ouricury wax, ozokerite, paraffin, PEG-6 beeswax, PEG-8 beeswax, rezowax, rice bran wax, shellac wax, spent grain wax, spermaceti wax, steryl dimethicone, synthetic beeswax, synthetic candelilla wax, synthetic carnauba wax, synthetic japan wax, synthetic jojoba wax, synthetic wax, and the like and mixtures thereof. For example, a particularly well suited wax includes about 70 weight percent ceresin wax, about 10 weight percent microcrystalline wax, about 10 weight percent paraffin wax and about 10 weight percent cetyl esters (synthetic spermaceti wax).

To provide the improved transfer to the skin of the wearer, the lotion formulation may include from about 5 to about 95 weight percent, desirably from about 25 to about 75 weight percent, and more desirably from about 40 to about 60 weight percent of the wax. Lotion formulations which include an amount of wax less than the recited amounts tend to have lower viscosities which undesirable leads to migration of the lotion. Whereas, lotion formulations which include an amount of wax greater than the recited amounts tend to provide less transfer to the wearer's skin.

A viscosity enhancer may be added to the lotion formulation to increase the viscosity to help stabilize the formulation on the body-facing surface 35 of the gown material and thereby reduce migration and improve transfer to the skin. Desirably, the viscosity enhancer increases the viscosity of the lotion formulation by at least about 50 percent, more desirably at least about 100 percent, even more desirably by at least about 500 percent, yet even more desirably by at least about 1000 percent, and even more desirably by at least about 5000 percent. Suitable viscosity enhancers which can be incorporated into the lotion formulation include polyolefin resins, lipophilic/oil thickeners, ethylene/vinyl acetate copolymers, polyethylene, silica, talc, colloidal silicone dioxide, zinc stearate, cetyl hydroxy ethyl cellulose and other modified celluloses and the like and mixtures thereof. For example, a particularly well suited viscosity enhancer is an ethylene/vinyl acetate copolymer commercially available from E. I. Dupont De Ne Mours, a business having offices located in Wilmington, Del. under the trade designation ELVAX.

To provide the improved transfer to the skin of the wearer, the lotion formulation may include from about 0.1 to about 25 weight percent, desirably from about 5 to about 20 weight percent, and more desirably from about 10 to about 15 weight percent of the viscosity enhancer for reduced migration and improved transfer to the wearer's skin.

If it is desired that the lotion formulation treat the skin, it can also include an active ingredient such as a skin protectant. Skin protectants may be a drug product which protects injured or exposed skin or mucous membrane surface from harmful or irritating stimuli. Suitable active ingredients, in addition to those mentioned above as suitable emollients, which can be incorporated into the lotion formulation include, but are not limited to, alantoin and its derivatives, aluminum hydroxide gel, calamine, cocoa butter, dimethicone, cod liver oil, glycerin, kaolin and its derivatives, lanolin and its derivatives, mineral oil, shark liver oil, talc, topical starch, zinc acetate, zinc carbonate, and zinc oxide and the like, and mixtures thereof. The lotion formulation may include from about 0.10 to about 95 weight percent of the active ingredient depending upon the skin protectant and the amount desired to be transferred to the skin.

In order to better enhance the benefits to the wearer, additional ingredients can be included in the lotion formulations of the present invention. For example, the classes of ingredients that may be used and their corresponding benefits include, without limitation: antifoaming agents (reduce the tendency of foaming during processing); antimicrobial actives; antifungal actives; antiseptic actives; antioxidants (product integrity); astringents—cosmetic (induce a tightening or tingling sensation on skin); astringent—drug (a drug product which checks oozing, discharge, or bleeding when applied to skin or mucous membrane and works by coagulating protein); biological additives (enhance the performance or consumer appeal of the product); colorants (impart color to the product); deodorants (reduce or eliminate unpleasant odor and protect against the formation of malodor on body surfaces); other emollients (help to maintain the soft, smooth, and pliable appearance of the skin by their ability to remain on the skin surface or in the stratum corneum to act as lubricants, to reduce flaking, and to improve the skin's appearance); external analgesics (a topically applied drug that has a topical analgesic, anesthetic, or antipruritic effect by depressing cutaneous sensory receptors, of that has a topical counterirritant effect by stimulating cutaneous sensory receptors); film formers (to hold active ingredients on the skin by producing a continuous film on skin upon drying); fragrances (consumer appeal), silicones/organomodified silicones (protection, tissue water resistance, lubricity, tissue softness), oils (mineral, vegetable, and animal); natural moisturizing agents (NMF) and other skin moisturizing ingredients known in the art; opacifiers (reduce the clarity or transparent appearance of the product); powders (enhance lubricity, oil adsorption, provide skin protection, astringency, opacity, etc.); skin conditioning agents; solvents (liquids employed to dissolve components found useful in the cosmetics or drugs); and surfactants (as cleansing agents, emulsifying agents, solubilizing agents, and suspending agents).

It should be appreciated by those skilled in the art that the protective garments according to the invention have wide applications, and that the example and embodiments set forth herein are merely exemplary. It is intended that the present invention include such uses and embodiments as come within the scope and spirit of the appended claims.

What is claimed is:

1. A protective garment, said garment comprising:

a body having a front portion and a back portion, said front and back portions defining sleeve openings;

sleeves attached to said sleeve openings along a generally continuous sleeve seam, said sleeves comprising an upper arm section and cuffs at an end thereof, said upper arm section comprising a circumference sized so as to be loose fitting on an intended wearer;

said sleeves further comprising a form-fitting section defined below said upper arm section, said form-fitting section comprising a reduced circumference so as to form fit to a wearer's forearm, said upper arm section and said form-fitting section formed from a common continuous material with a distinct angled transition zone between said upper arm section and said form-fitting section such that said form-fitting section fits snuggly against the intended wearer's forearm from said transition zone to said cuff; and a skin wellness agent deposited on an inner circumferential surface of said form-fitting section, said skin wellness agent being transferred to the wearer's skin through contact with said form-fitting section.

2. The protective garment as in claim 1, wherein said skin wellness agent is deposited as a generally uniform coating on said inner circumferential surface of said form-fitting section.

3. The protective garment as in claim 1, wherein said skin wellness agent is deposited in discrete locations on said inner circumferential surface of said form-fitting section.

4. The protective garment as in claim 1, wherein said sleeves are formed from folded blank members with a single seam along said folded blank member.

5. The protective garment as in claim 1, wherein said sleeves are formed from folded blank members with two seams along said form-fitting section, and a single seam along said upper arm section.

6. The protective garment as in claim 1, wherein said skin wellness agent is selected from one or any combination of the group of agents consisting of a lotion formulation, an emollient, a skin protectant, and a wax.

7. The protective garment as in claim 1, wherein said skin wellness agent is applied to said sleeves below said upper arm section and including said cuffs.

8. The protective garment as in claim 1, wherein at least said form-fitting section of said sleeves comprises an elastomeric material.

* * * * *